US008970444B2

(12) United States Patent
Gustafsson et al.

(10) Patent No.: US 8,970,444 B2
(45) Date of Patent: Mar. 3, 2015

(54) POLARIZATION DEPENDENT BEAMWIDTH ADJUSTER

(75) Inventors: Mattias Gustafsson, Göteborg (SE); Stefan Johansson, Romelanda (SE); Anders Ek, Hisings Backa (SE)

(73) Assignee: Telefonaktiebolaget L M Ericsson (publ), Stockholm (SE)

( * ) Notice: Subject to any disclaimer, the term of this patent is extended or adjusted under 35 U.S.C. 154(b) by 793 days.

(21) Appl. No.: 12/594,760

(22) PCT Filed: Apr. 5, 2007

(86) PCT No.: PCT/SE2007/050223
§ 371 (c)(1), (2), (4) Date: Oct. 5, 2009

(87) PCT Pub. No.: WO2008/123810
PCT Pub. Date: Oct. 16, 2008

(65) Prior Publication Data
US 2010/0117916 A1 May 13, 2010

(51) Int. Cl.

| | |
|---|---|
| ***H01Q 21/24*** | (2006.01) |
| ***H01Q 21/08*** | (2006.01) |
| ***H01Q 25/00*** | (2006.01) |
| ***H01Q 1/24*** | (2006.01) |
| ***H01Q 9/04*** | (2006.01) |

(52) U.S. Cl.
CPC ..... *H01Q 25/002* (2013.01); *H01Q 1/243* (2013.01); *H01Q 9/045* (2013.01); *H01Q 21/08* (2013.01)
USPC ..... 343/839; 343/835

(58) Field of Classification Search
CPC ..... H01Q 21/08; H01Q 25/001–25/002
USPC ..... 343/839, 834–837, 872
See application file for complete search history.

(56) References Cited

U.S. PATENT DOCUMENTS

| | | | | |
|---|---|---|---|---|
| 5,977,914 | A * | 11/1999 | Harano | 343/700 MS |
| 6,067,053 | A * | 5/2000 | Runyon et al. | 343/797 |
| 7,218,288 | B2 * | 5/2007 | Kimura | 343/812 |
| 7,427,966 | B2 * | 9/2008 | Boss et al. | 343/797 |
| 2004/0201537 | A1 * | 10/2004 | Stolle et al. | 343/797 |

FOREIGN PATENT DOCUMENTS

| | | |
|---|---|---|
| EP | 0 895 303 A1 | 2/1999 |
| EP | 0 973 231 A2 | 1/2000 |

(Continued)

*Primary Examiner* — Robert Karacsony
*Assistant Examiner* — Amal Patel

(57) ABSTRACT

The invention provides a dual polarized antenna or antenna array with a first and second radiation pattern having a first and second polarization, a method for adjustment of said antenna or antenna array and a wireless communication system comprising said antenna or antenna array. The antenna or antenna array comprises a main radiating antenna element or array of main radiating antenna elements arranged above a conductive frame. Then invention further provides an antenna or antenna array wherein a combination of conductive parasitic strips and chokes are arranged in association with the main radiating antenna element to achieve means for independently controlling beamwidths of the first and second radiation pattern a method for adjustment to achieve a desired beamwidth for each polarization, wherein the beamwidth adjustment for first and second radiation pattern is made independently of each other a wireless communication system including base stations equipped with a dual polarized antenna or antenna array according to the invention.

15 Claims, 6 Drawing Sheets

(56) References Cited

FOREIGN PATENT DOCUMENTS

| | | | |
|---|---|---|---|
| JP | S62-018602 | | 1/1987 |
| JP | H02-070104 | A | 3/1990 |
| JP | 2833802 | B | 7/1991 |
| JP | H04-120903 | A | 4/1992 |
| JP | H11-284429 | A | 10/1999 |
| JP | 2003-078339 | A | 3/2003 |
| WO | WO 00/01032 | A1 | 1/2000 |
| WO | WO 2006/011844 | A1 | 2/2006 |

* cited by examiner

POLARIZATION DEPENDENT BEAMWIDTH ADJUSTER

TECHNICAL FIELD

The invention relates to the technical field of antennas used in wireless communication systems.

BACKGROUND

The beamwidth of antenna elements located near groundplanes is traditionally adjusted by changing the antenna element dimensions and the groundplane extension.

Base station antennas frequently operate with two orthogonal linear polarizations for diversity (polarization diversity). For GSM (Global System for Mobile Communication) and WCDMA (Wideband Code Division Multiple Access) it is common to use slant linear polarizations, oriented +/−45 degrees with respect the vertical plane. An attractive alternative is to use vertical and horizontal polarization, i.e. 0 and 90 degrees polarization. When using antennas with dual polarization (e.g. vertical and horizontal polarization) on the same mechanical structure, it can be quite complicated to make a design that gives the desired horizontal beamwidth for both polarizations simultaneously. Thus it is beneficial with a design that contains design parameters that controls the horizontal beamwidth for each polarization individually.

SUMMARY

The object of the invention is to provide a dual polarized antenna or antenna array with a first and second radiation pattern having a first and second polarization, a method for adjustment of said antenna or antenna array and a wireless communication system comprising said antenna or antenna array which can solve the problem to obtain a desired horizontal beamwidth simultaneously for the first radiation pattern with a first polarization and the second radiation pattern with the second polarization. The antenna or antenna array comprises a main radiating antenna element, or array of main radiating antenna elements, having a main extension in an extension plane and a longitudinal extension. The main radiating antenna element or array of main radiating antenna elements is arranged above a conductive frame, the perpendicular projection of the main radiating antenna element or array of main radiating antenna elements towards a frame surface falling within an area of the frame surface.

This object is achieved by:

- an antenna or antenna array wherein a combination of conductive parasitic strips and chokes is arranged in association with the main radiating antenna element, or array of main radiating antenna elements, to achieve means for independently controlling beamwidths of the first and second radiation pattern in a plane substantially perpendicular to the longitudinal extension of the antenna or antenna array
- a method for adjustment to achieve a desired beamwidth in a plane substantially perpendicular to the longitudinal extension for each polarization, wherein the beamwidth adjustment for the first and the second radiation pattern is made independently of each other and comprising the steps of:
  - arranging conductive parasitic strips in association with a main radiating antenna element or an array of main radiating antenna elements to control the beam width of the first polarization and arranging at least two chokes in association with the main radiating antenna element or array of main radiating antenna elements to control the beamwidth of the second polarization.
- a wireless communication system including base stations equipped with a dual polarized antenna or antenna array according to the invention.

A radiation pattern in a plane substantially perpendicular to the longitudinal extension of the antenna or antenna array is henceforth in the description called the horizontal radiation pattern.

Polarization substantially parallel to the extension plane and the longitudinal extension of the antenna or antenna array is henceforth in the description called the vertical polarization.

Polarization substantially parallel to the extension plane and perpendicular to the longitudinal extension of the antenna or antenna array is henceforth in the description called the horizontal polarization.

The invention makes it possible to individually tune the beamwidth for vertical and horizontal polarization and when desired, tune such as to obtain equal beamwidths for both polarizations. The invention also makes it possible to accomplish equal horizontal beamwidth and horizontal beam pointing for any other dual polarization (e.g. +/−45° since any polarization can be decomposed into one vertically polarized component and one horizontally polarized component and thus having equal radiation patterns for vertical and horizontal polarization will give equal patterns for any other pair of polarization. The implementation of the tuning is simple to achieve, the conductive parasitic strips can in one embodiment be etched on a substrate common with the antenna. The mechanical implementation of the choke is simple and can be realized with traditional die-casting or extrusion.

The conductive parasitic strips and chokes are located with reference to the main radiating antenna element, such as a patch antenna. The main radiating antenna element can also be of other types, such as dual polarized dipoles, slots, stacked patches, etc. The main radiating antenna element is henceforth in the description exemplified with a patch element.

When exciting the patch with vertical polarization (normal to the plane of FIG. 1), the fields will be short circuited by the conductive parasitic strips since the field is parallel to the conductive parasitic strips, i.e. the conductive parasitic strips will act as a broadening of the ground plane. By choosing the position and the width of the conductive parasitic strips, the beamwidth for the vertical polarization can hence be adjusted. There can also be two or more conductive parasitic strips on each side. The choke will have negligible influence on the field as long as the width is small in terms of the wavelength; since the field in this case is oriented parallel to the choke (i.e. the chokes are almost invisible to the E-field parallel to the choke).

When exciting the patch with horizontal polarization, the field will cross the conductive parasitic strips perpendicular to the conductive parasitic strips and as long as the width of the conductive parasitic strips is small with respect to the wavelength the field is almost unaffected (i.e. the conductive parasitic strips are almost invisible to the E-field perpendicular to the conductive parasitic strips). However, choosing the position and the depth of the chokes will affect the beamwidth of the horizontal polarization since the current flow at the choke entrance will be affected by the choke impedance. Thus the position, dimensions and orientation of chokes can be used to control the horizontal radiation pattern for the horizontal polarization with a minor impact on the radiation pattern for the vertical polarization.

Further advantages can be obtained by implementing features of the dependent claims covering different embodiments of the antenna or antenna array with variations regarding the position of the conductive parasitic strips in relation to the main radiating antenna element, number and shape of conductive parasitic strips, an angle of the conductive parasitic strips in relation to the frame surface and the relative position between the conductive parasitic strips. The conductive parasitic strips can also be realized as wires, rods or tubes. Variations regarding the position of the chokes in relation to the main radiating antenna element, number of chokes, as well as alignment of the chokes in relation to the frame surface are also within the scope of the invention and covered in the dependent claims.

The chokes can be aligned parallel to the extension plane of the antenna or antenna array and extending in the longitudinal extension of the antenna or antenna array. This is henceforth in the description called the extension plane alignment.

The chokes can also be aligned in a normal plane, perpendicular to the extension plane of the antenna or antenna array and extending in the longitudinal extension of the antenna or antenna array. This is henceforth in the description called the normal plane alignment.

Additional advantages are obtained if features of the dependent claims for the adjustment method are implemented. An adjustment method of the first polarization can be performed by optimizing certain parameters regarding the conductive parasitic strips such as the position of the strips in relation the main radiating antenna element, number of conductive parasitic strips, and angle of the conductive parasitic strips in relation to the frame surface. Other optimizing parameters can be the width of the conductive parasitic strip. The conductive parasitic strips can also e.g. be realized as wires.

An adjustment method of the second polarization can be performed by optimizing a number of choke parameters, practically independent of the adjustment parameters of the first polarization. These choke parameters comprise the position of the chokes in relation to the main radiating antenna element, number of chokes and alignment of the chokes in relation to the frame surface.

DETAILED DESCRIPTION

The invention will now be described in detail with reference to the drawings and some examples on how to implement the invention. Other implementations are possible within the scope of the invention.

Figure 1:
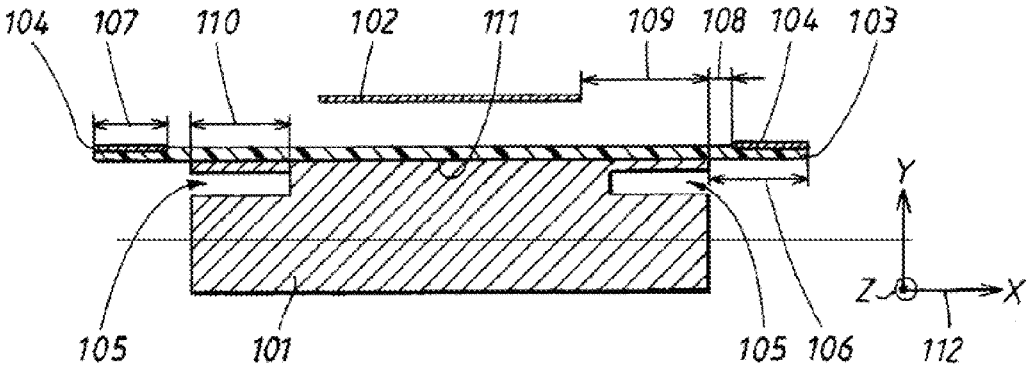
FIG. 1 schematically shows a cross section of an antenna structure where the conductive parasitic strips are located in the same plane as the substrate, and the chokes have extension plane alignment.

A first implementation example of an antenna or antenna array having a main extension in a plane parallel to an x/z-plane as defined by coordinate symbol 112 is shown in FIG. 1. This is henceforth in the description called the extension plane of the antenna or antenna array. A plane parallel to the y/z-plane is defined as a normal plane of the antenna or antenna array. The antenna or antenna array also has an extension direction in the z-direction defined as a longitudinal extension, henceforth in the description called the longitudinal extension. In FIG. 1 conductive parasitic strips are located in the same plane as a substrate, and chokes are aligned parallel to the extension plane, i.e. they have an extension plane alignment. The antenna structure comprises a substrate 103 mounted on a conductive frame 101, serving as a ground plane and having a frame surface 111 facing a main radiating antenna element 102. The substrate extends outside the frame on two opposite sides by a distance 106. Conductive parasitic strips 104 with a width 107 are applied on the surface of the parts of the substrate extending outside the frame. A gap 108 between the conductive parasitic strips and the frame is defined as the difference between the distances 106 and 107. The conductive main radiating antenna element 102, here exemplified with a patch, is arranged above and substantially parallel with the substrate with a perpendicular projection towards the frame surface 111 being within the surface area of the frame and at a distance 109 from the longitudinal side edges of the frame. A choke 105 realized as a notch, having an extension plane alignment, with a depth 110 extends along two opposite longitudinal sides of the frame and in the same direction as the conductive parasitic strips. For vertical polarization, i.e. when the electrical field is perpendicular to the plane of the figure, the fields will be short circuited by the conductive parasitic strips since the E-field is parallel to the conductive parasitic strips. This has the effect that the conductive parasitic strips will act as broadening of the ground plane. By choosing the position and the width of the conductive parasitic strips, the beamwidth for the vertical polarization can hence be adjusted. In the example of FIG. 1 there is one conductive parasitic strip at each opposite longitudinal side of the frame. There can also be two or more conductive parasitic strips at each side. The choke will have a negligible influence on the field as long as the notch width is small in terms of wavelength, since the field in this case is oriented parallel to the choke (i.e. the chokes are almost invisible to the E-field parallel to the choke). In order for the conductive parasitic strips to have the broadening effect the gap 108 as defined above has to be less than roughly ¼-½ wavelength.

The patch can e.g. be arranged above the substrate and the frame by plastic supports (not shown in the figure) provided at each corner of the patch and attached to the substrate. In a further embodiment the patch can be attached directly to the substrate, i.e. both the patch and the conductive parasitic strips are attached to the substrate.

When exciting the patch with horizontal polarization, i.e. in the plane of the figure, the field will cross the conductive parasitic strips perpendicular to the conductive parasitic strips and as long as the width of the conductive parasitic strips is small with respect to the wavelength the field is almost unaffected (i.e. the conductive parasitic strips are almost invisible to the E-field perpendicular to the conductive parasitic strips). However, choosing the position and the depth of the chokes will affect the beamwidth of the horizontal polarization since the current flow at the choke entrance will be affected by the choke impedance. Thus the position, dimensions and orientation of the chokes can be used to control the horizontal radiation pattern, i.e. the radiation in a plane substantially perpendicular to the longitudinal extension of the antenna or antenna array, for the horizontal polarization with a negligible impact on the radiation pattern for the vertical polarization. The most sensitive tuning parameter is the depth of the choke notch.

The dual polarization feeding of the patch can be arranged in any conventional way well known to the skilled person. A typical feeding solution is to use a multilayer Printed Circuit Board (PCB) as the substrate and integrate a crossed slot in a metallized bottom layer of the PCB, the feeding of each slot in a second layer and the conductive parasitic strips in a third top layer. The patches can also be arranged in this third, top layer or above the substrate on plastic supports attached to the substrate and each corner of the patches.

Figure 2:
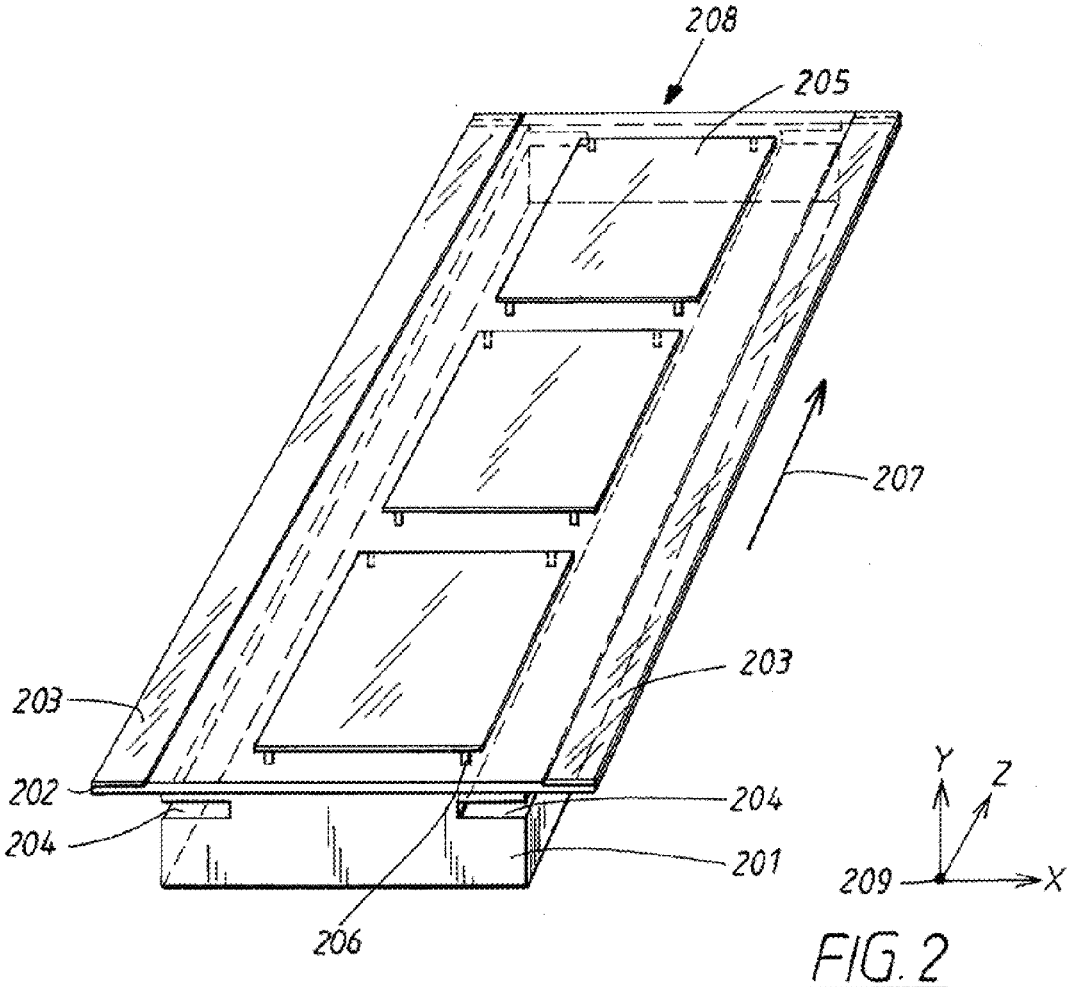
FIG. 2 schematically shows a perspective view of an array of patches.

The antenna structure can include one patch or a number of patches arranged in a linear array. A linear array with the longitudinal extension 207 is shown in FIG. 2 with a substrate 202 mounted on a frame 201, usually referred to as the ground plane. Chokes 204 with extension plane alignment are arranged on opposite longitudinal sides of the frame. Conductive parasitic strips 203 are applied to opposite longitudinal sides of the substrate and one column 208 of patches 205 are mounted on supports 206 attached to the substrate and each corner of the patch. The number of patches is depending on the actual application but is typically around 4-20 for base station applications, but other numbers are also possible within the scope of the invention. For certain application it can also be suitable to use two or more columns 208 of patches mounted in parallel. The extension plane of the antenna array, as defined above, is the x/z-plane. The normal plane is a plane parallel to the y/z-plane.

Figure 3:
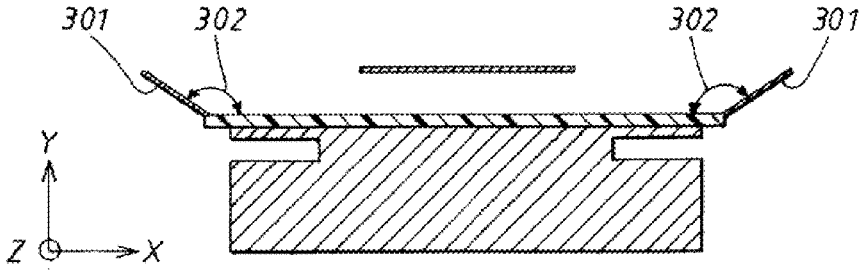
FIG. 3 schematically shows a cross section of an antenna structure where the conductive parasitic strips are angled with reference to the substrate plane, and the chokes have extension plane alignment.

A second implementation is shown in FIG. 3 where conductive parasitic strips 301 are angled with reference to the substrate plane, and the chokes with extension plane alignment as in FIG. 1. The example according to FIG. 3 has the same structure as the example of FIG. 1 except that the conductive parasitic strips 301 are now arranged at two opposite side edges with an angle 302 between the conductive parasitic strips and the substrate. The arrangement of the conductive parasitic strips can be made by any suitable mechanical means. This example adds an additional parameter, the angle 302, to be used for fine tuning and optimizing the beam width for vertical polarization.

Figure 4:
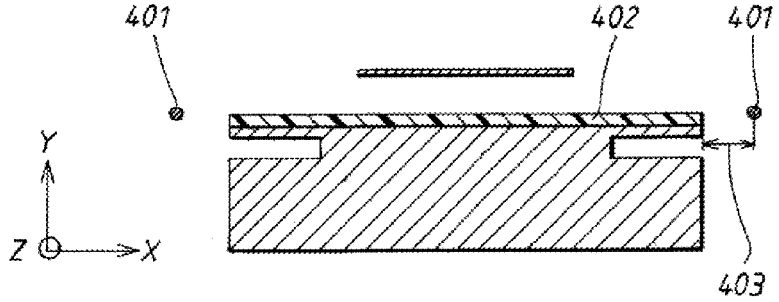
FIG. 4 schematically shows a cross section of an antenna structure where the conductive parasitic strips are realized as wires, rods or tubes and the chokes have extension plane alignment.

A third implementation is shown in FIG. 4 where conductive parasitic strips are realized as wires, rods or tubes 401, and the chokes have extension plane alignment. Henceforth in the description the realization of strips as wires, rods or tubes are exemplified by wires. The antenna structure has the same basic structure as in FIG. 1 except that a substrate 402 now has the same dimensions as the frame, and thus not extending outside the frame as described in association with FIG. 1, and that the conductive parasitic strips now are realized as the wires 401. The wires are aligned along two opposite sides of the substrate at a constant distance 403 from the substrate and extending in the same direction as the chokes. The distance 403 has to be less than ¼-½ wavelength in order to obtain the effect of serving as broadening of the ground plane for the vertical polarization. Spacers, between wire and substrate, can be used to align the wires along the sides of the substrate (not shown in the figure).

Figure 5:
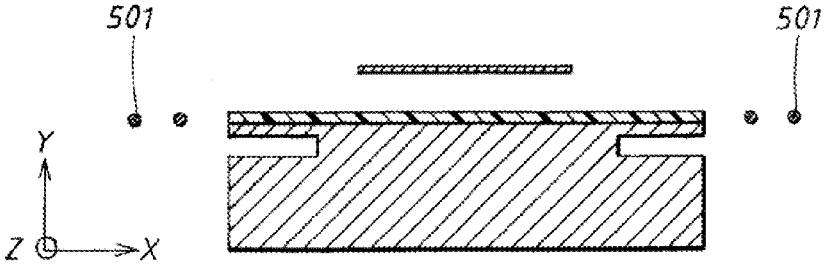
FIG. 5 schematically shows a cross section of an antenna structure where the conductive parasitic strips are realized as several wires, rods or tubes and the chokes have extension plane alignment.

A fourth implementation is shown in FIG. 5 where the conductive parasitic strips are realized as several wires, and the chokes have extension plane alignment. This embodiment differs from the alternative in FIG. 4 only by the addition of a further wire 501 on each side of the frame. Three or more wires can also be used at each side. This example adds additional parameters, the number of wires and distances between wires, to be used for fine tuning and optimizing the beam width for vertical polarization.

Figure 6:
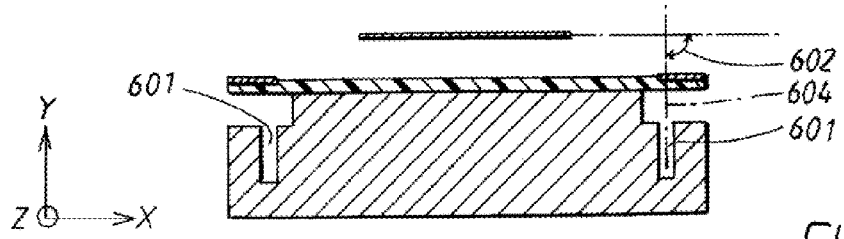
FIG. 6 schematically shows a cross section of an antenna structure where the conductive parasitic strips are aligned with the substrate, and the chokes have normal plane alignment.

A fifth implementation is shown in FIG. 6 where the conductive parasitic strips are aligned with the substrate, and the chokes have normal plane alignment. This means that the angle 602 between the extension plane and the alignment of the notch of the choke is 90°. This embodiment differs from the alternative according to FIG. 1 by replacing the chokes with an extension plane alignment, by chokes 601 having normal plane alignment. The angle 602 can also have any value between 0-180°. This is an alternative mechanical embodiment to the embodiment of FIG. 1 illustrating that the orientation of the choke is not critical for the optimization of the beamwidth for the horizontal polarization. The chokes can also have an angle between 0-90 degrees to the y/z-plane, 90 degrees being the extension plane alignment of the choke. The orientation of the chokes adds additional possibilities for tuning the beamwidth for the horizontal polarization.

Figure 7:
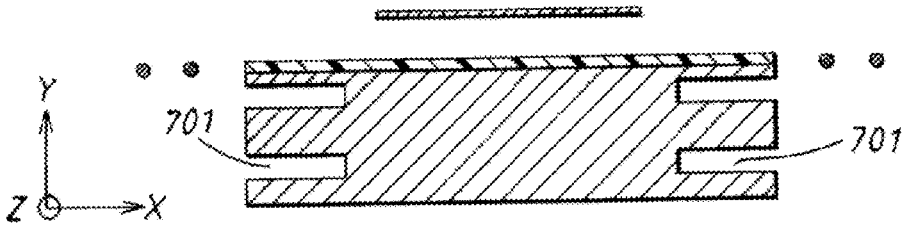
FIG. 7 schematically shows a cross section of an antenna structure where the conductive parasitic strips are realized as two wires, rods or tubes and two chokes with extension plane alignment.

A sixth implementation is shown in FIG. 7 where the conductive parasitic strips are realized as several wires, and several chokes have extension plane alignment. This embodiment differs from the embodiment of FIG. 5 by adding an additional choke 701 having extension plane alignment at each side of the frame. This adds additional parameters, the number of chokes and distance between chokes, to be used for fine tuning and optimizing the beam width for horizontal polarization. Further chokes can be added at each side of the frame.

Figure 8:
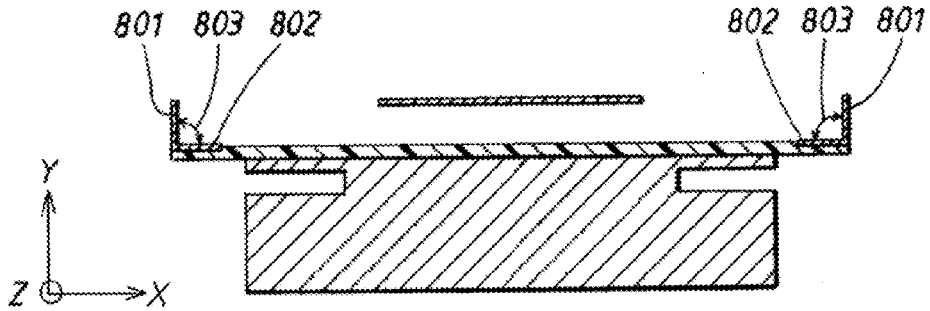
FIG. 8 schematically shows a cross section of an antenna structure where the conductive parasitic strips are non planar, and the chokes have extension plane alignment.

A seventh implementation is shown in FIG. 8 where the conductive parasitic strips are non-planar, and the chokes have extension plane alignment. This embodiment differs from the embodiment of FIG. 1 by adding a flange 801 to the conductive parasitic strip 802. There is an angle 803 between the conductive parasitic strip and the flange. In the embodiment of FIG. 8 the angle 803 is 90°. The angle can however assume any value between 0-360°. The height and angle of the flange adds additional possibilities for tuning the beamwidth for the vertical polarization.

Figure 9:
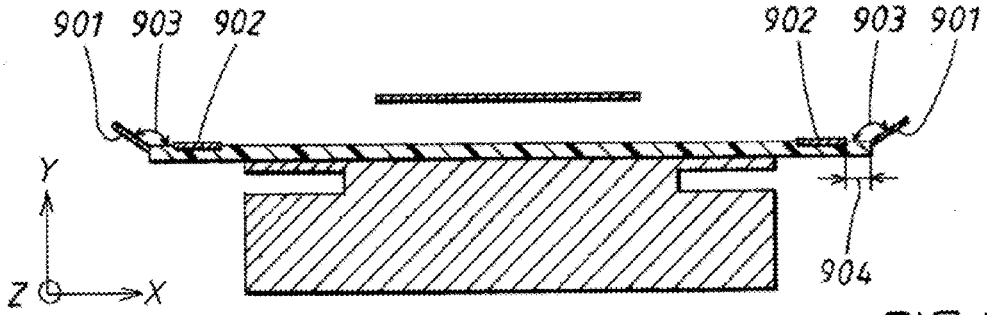
FIG. 9 schematically shows a cross section of an antenna structure with several conductive parasitic strips that can be non planar and chokes that have extension plane alignment.

An eighth implementation is shown in FIG. 9 where several non-planar conductive parasitic strips and chokes with extension plane alignment are used. This embodiment differs from the embodiment of FIG. 1 in that conductive parasitic strips 902 attached to the dielectric substrate has a distance 904 to the longitudinal sides of the dielectric substrate and that additional conductive parasitic strips 901 are added and attached to the opposite longitudinal side edges of the dielectric substrate with an angle 903 between the dielectric substrate and the conductive parasitic strips. The angle can however assume any value between 0-360°. The conductive parasitic strip 901 can be planar or curved. Additional planar and curved conductive parasitic strips can be added.

In the examples described the frame surface 111 is planar. In other embodiments the frame surface can also be curved.

Figure 10:
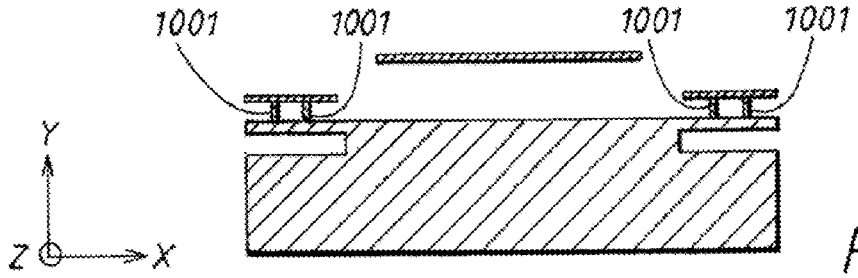
FIG. 10 schematically shows a cross section of an antenna structure with the conductive parasitic strips attached to the conductive frame by a support structure.

FIG. 10 shows an embodiment without the dielectric substrate. The conductive parasitic strips are here attached to the conductive frame by a support structure 1001, here realized as support pins.

Farfield radiation measurements have been performed on an antenna with different polarizations (e.g. vertical and horizontal polarization) on the same mechanical structure. An implementation example with and without chokes in the structure has been examined. Position and configuration of the conductive parasitic strips, choke position and depth have been tuned to obtain the optimum beamwidth for the two polarizations. FIGS. 11 and 12 show beamwidth versus frequency for vertical and horizontal polarization. FIG. 11 shows beamwidths without chokes and FIG. 12 shows the same, but with chokes implemented.

Figure 11A:
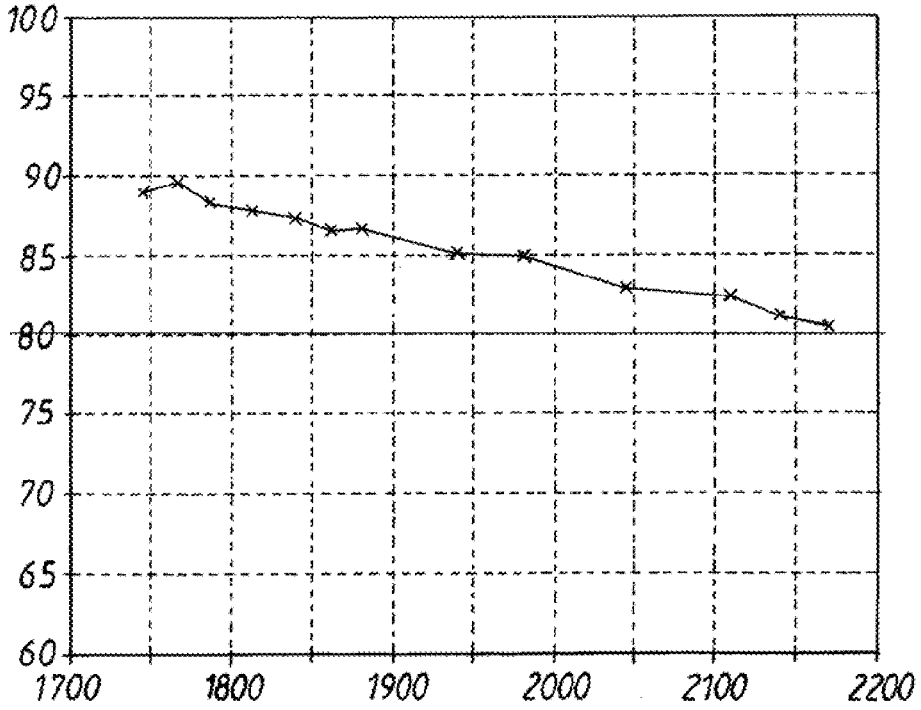
FIGS. 11*a* and 11*b* shows beam width diagrams as a function of frequency for vertical and horizontal polarization for an antenna structure according to the invention but without chokes.
Figure 11B:
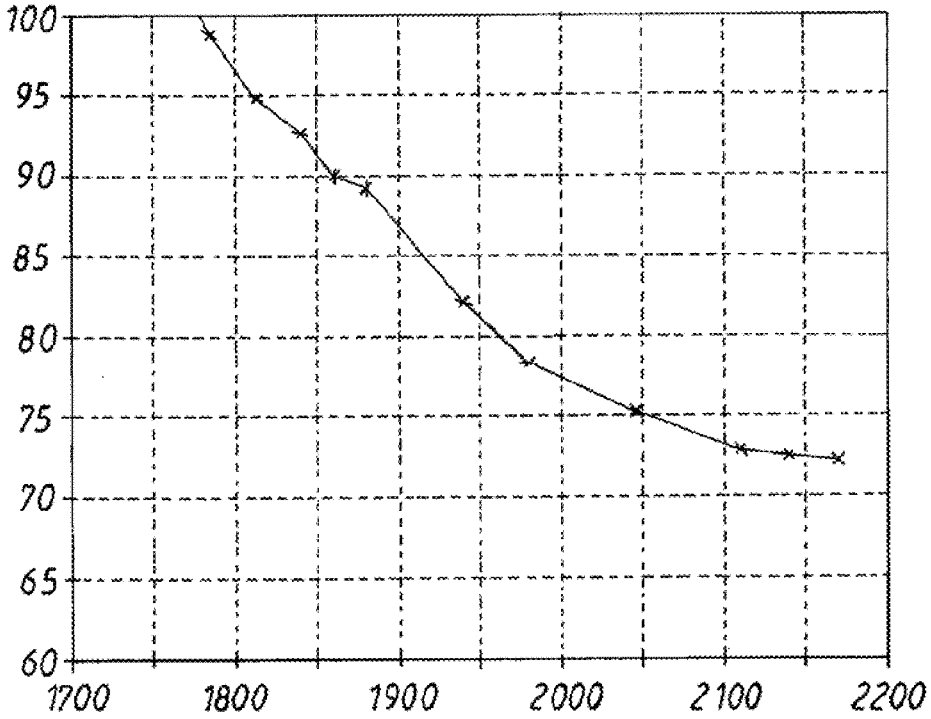
Figure 12A:
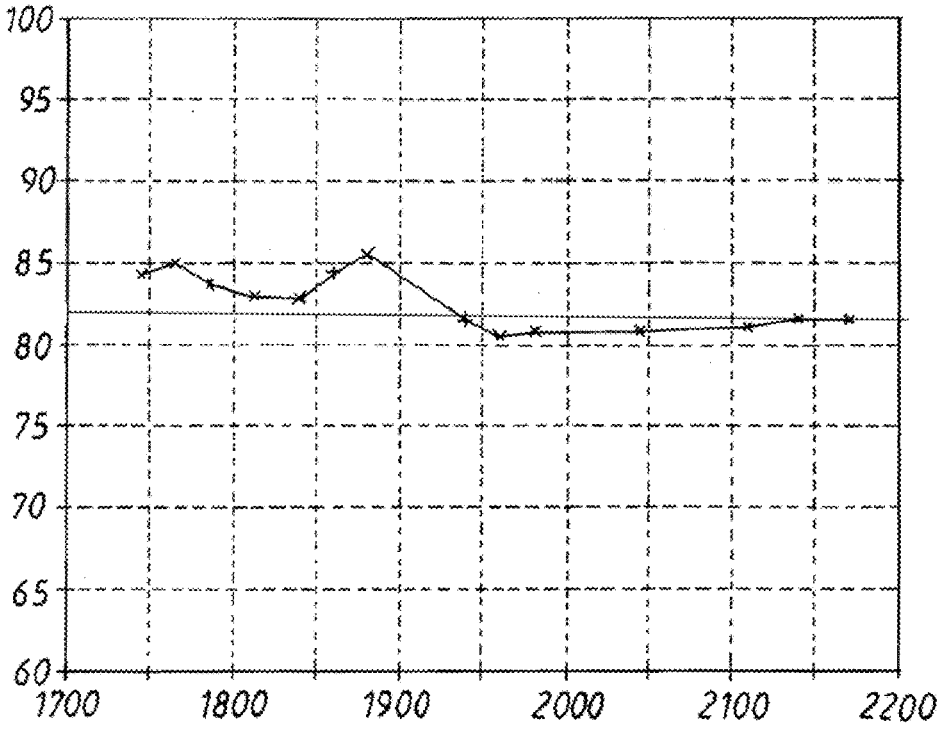
FIGS. 12*a* and 12*b* shows beam width diagrams as a function of frequency for vertical and horizontal polarization for an antenna structure according to the invention.
Figure 12B:
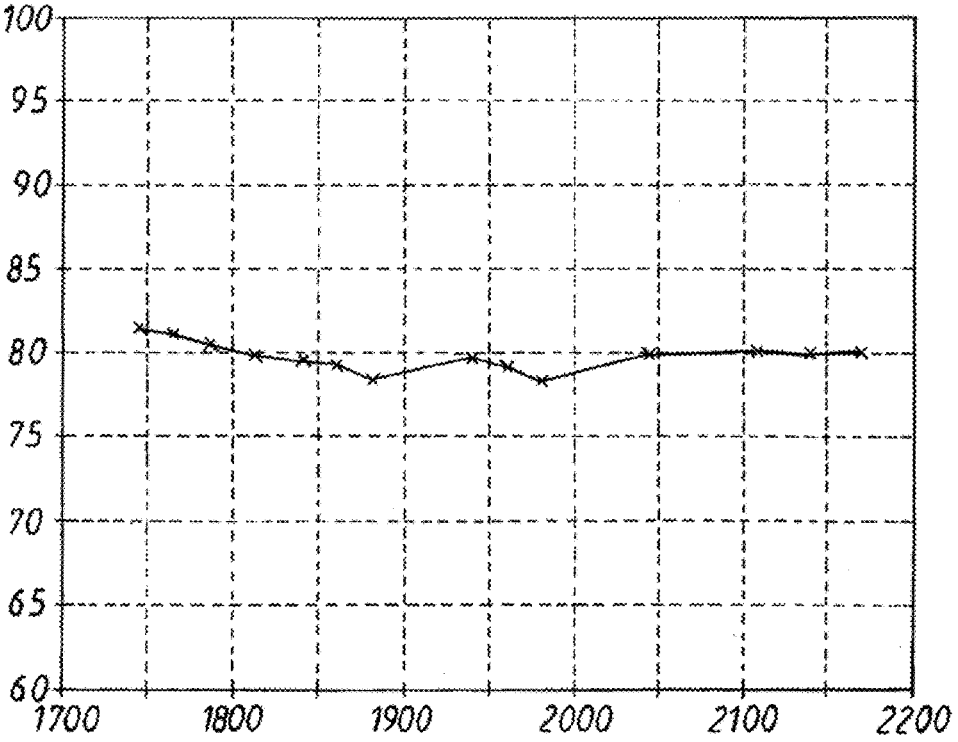

FIGS. 11 and 12 have 3 dB beamwidth values in degrees on the vertical axis and frequency in MHz on the horizontal axis. FIGS. 11*a* and 12*a* show beamwidths for vertical polarization and FIGS. 11*b* and 12*b* show beamwidths for horizontal polarization. FIG. 11*b* shows very large variations in beamwidth when chokes are not used. FIG. 12*b* shows the result when chokes are implemented; the horizontal beamwidth becomes very stable within the frequency range. FIG. 12*a* shows the result for the vertical polarization when configuration and position of the conductive parasitic strips have been tuned to optimize the beamwidth for the vertical polarization. In summary, the vertical polarization is tuned with varying conductive parasitic strip parameters and the horizontal polarisation by tuning depth and position of the chokes. The tuning procedures for the beamwidth of the polarizations are almost independent of each other, i.e. when tuning the beamwidth of the vertical polarization by changing conductive parasitic strip parameters it does not affect the beamwidth of the horizontal polarization.

Figure 13:
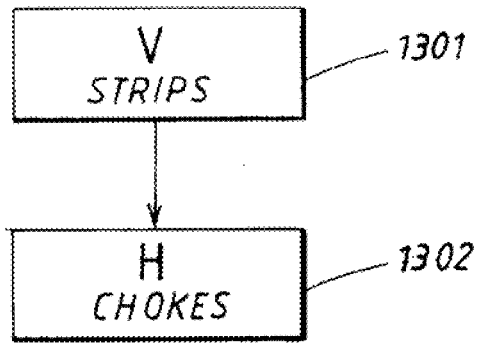
FIG. 13 is a block diagram illustrating the method for adjusting the beamwidths of the two polarizations.

The basic method for adjusting the beamwidth is described in FIG. 13. The beamwidth adjustment for first and second radiation pattern is made by arranging parasitic elements in association with the main radiating element to control the beam width of the first polarization 1301 and by arranging chokes in association with the main radiating element to control the beamwidth of the second polarization 1302. In FIG. 13 the first polarization is exemplified with vertical polarization (V) and the second polarization by horizontal polarization (H).

The beamwidth of the vertical polarization can then be further adjusted and optimized by:

locating the conductive parasitic strips at certain positions in relation to the main radiating element modifying the shape and/or number of the conductive parasitic strips changing the relative position between the conductive parasitic strips.

The beamwidth of the horizontal polarization can then also be further adjusted and optimized by:

locating the at least two chokes at certain positions in relation to the main radiating element modifying the shape, depth and/or number of chokes modifying the relative position between the chokes varying the alignment of the chokes.

Figure 14:
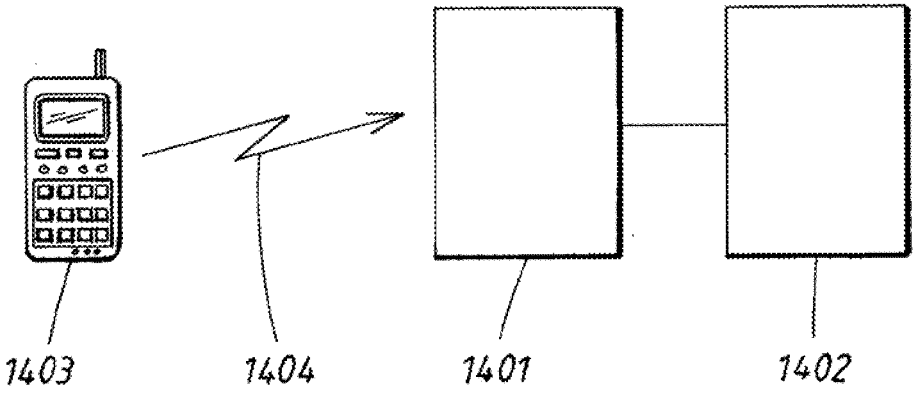
FIG. 14 schematically shows a wireless communication system.

A wireless communication system comprising a base station 1401 connected to a communications network 1402 and to mobile units 1403 via an air interface 1404 is shown in FIG. 14. Examples of such systems are networks for GSM (Global System for Mobile Communication) and various 3G (third generation) systems for mobile communication. The invention also covers such wireless communication systems including base stations equipped with an antenna or antenna array according to the apparatus claims of the invention.

The invention is not limited to the embodiments above, but may vary freely within the scope of the appended claims.

The invention claimed is:

1. A dual polarized antenna structure, in a wireless communications system, with a first radiation pattern having a first polarization and a second radiation pattern having a second polarization, the antenna structure comprising:

a plurality of main radiating antenna elements, each main radiating antenna element having a longitudinal extension in an extension plane, the main radiating antenna elements being arranged along the longitudinal extension and above a conductive frame serving as a ground plane, and a perpendicular projection of each of the main radiating antenna elements onto a surface of the conductive frame falling within an area of the frame surface; and a combination of conductive parasitic strips and chokes, realized with a notch spanning substantially an entire length of each of opposite longitudinal sides of the conductive frame, the conductive parasitic strips and notches being arranged in association with the main radiating antenna elements to control beam widths of the first radiation pattern and second radiation pattern in a plane perpendicular to the longitudinal extension of the main radiating antenna elements, wherein the conductive strips are arranged beside the plurality of main radiating antenna elements along the direction of the longitudinal extension, wherein the first and second polarizations are linear polarizations that are orthogonal to each other, and wherein an arrangement of the notches and an arrangement of the conductive parasitic strips, respectively and substantially independently, affect beam widths of the first radiation pattern and beam widths of the second radiation pattern.

2. The antenna structure according to claim 1, wherein the conductive parasitic strips are attached to the conductive frame by a support structure.

3. The antenna structure according to claim 2, wherein at least one of the conductive parasitic strips is attached along each opposite longitudinal side of the conductive frame by the support structure and outside of an area of the perpendicular projection of the main radiating antenna elements onto the frame surface.

4. The antenna structure according to claim 2, wherein the support structure is a dielectric substrate mounted to the frame surface facing the main radiating antenna element and covering at least the frame surface; and at least one of the conductive parasitic strips is applied to the surface of the dielectric substrate facing the main radiating antenna elements, along each opposite longitudinal side of the dielectric substrate and outside an area of the perpendicular projection of the main radiating antenna element onto the frame surface or the at least one conductive parasitic strip is attached along each opposite longitudinal side of the dielectric substrate by means of supports extending from the dielectric substrate to the conductive parasitic strips.

5. The antenna structure according to claim 3, wherein:

the conductive parasitic strips being substantially parallel to the longitudinal extension are attached to the opposite longitudinal side edges of the conductive frame with an angle between the conductive parasitic strips and the extension plane, or the conductive parasitic strips being substantially parallel to the extension plane are attached to the opposite longitudinal side edges of the conductive frame by the support structure and having a distance to longitudinal sides of additional conductive parasitic strips attached to the opposite longitudinal side edges of the conductive frame with an angle between the extension plane and the additional conductive parasitic strips.

6. The antenna structure according to claim 4, wherein:

the conductive parasitic strips being substantially parallel to the longitudinal extension are attached to the opposite longitudinal side edges of the dielectric substrate with an angle between the conductive parasitic strips and the extension plane, or the conductive parasitic strips being substantially parallel to the extension plane are attached to the opposite longitudinal side edges of the dielectric substrate having a distance to the longitudinal sides of the dielectric substrate wherein additional conductive parasitic strips are attached to the opposite longitudinal side edges of the dielectric substrate with an angle between the longitudinal extension and the additional conductive parasitic strips.

7. The antenna structure according to claim 1, wherein:

at least one of the notches is substantially parallel to the extension plane of the antenna structure and extending in the longitudinal extension of the antenna structure, or the at least one notch has an angle between the extension plane of the antenna structure and an alignment axis of the notch being 90°, or the angle having a value between 0-180°.

8. The antenna structure according to claim 1, wherein the conductive parasitic strips are realized as wires, rods or tubes.

9. The antenna structure according to claim 1, wherein a flange is added to the conductive parasitic strip with an angle between the conductive parasitic strip and the flange.

10. The antenna structure according to claim 1, wherein the conductive parasitic strips are curved.

11. The antenna structure according to claim 1, wherein the main radiating antenna element is a patch or the main radiating antenna element is a dual polarized dipole.

12. The antenna structure according to claim 1, wherein the first polarization is substantially parallel to the extension plane and the longitudinal extension of the antenna and the second polarization is substantially parallel to the extension plane and perpendicular to the longitudinal extension of the antenna.

13. The antenna structure according to claim 1, wherein the notches are cut out of the conductive frame.

14. A method in a wireless communications system of adjusting a dual polarized antenna having a first radiation pattern with a first polarization and a second radiation pattern with a second polarization for achieving a desired beam width in a plane substantially perpendicular to a longitudinal extension for each polarization, the beam width adjustment for the first radiation pattern and the second radiation pattern is made independently of each other, the method comprising the steps of:

utilizing a conductive frame as a ground plane, a dielectric substrate mounted on the conductive frame, the dielectric substrate extending outside the frame on two opposite sides;

arranging conductive parasitic strips on a first side of the dielectric substrate, in association with a plurality of main radiating antenna elements to control the beam width of the first polarization, the plurality of main radiating antenna elements being arranged along the longitudinal extension and the conductive strips being arranged beside the plurality of main radiating antenna elements along the direction of the longitudinal extension; and arranging at least two chokes, realized with a notch spanning substantially an entire length of each of opposite longitudinal sides of the conductive frame, the at least two chokes being separated from the conductive parasitic strips by the dielectric substrate and positioned on a second side opposite of the first side of the dielectric substrate, in association with the main radiating antenna elements to control the beam width of the second polarization, wherein the first and second polarizations are linear polarizations that are orthogonal to each other.

15. The method according to claim 14, wherein:

the control of the beam width of the first polarization is made by locating the at least two conductive parasitic strips at certain positions in relation to the main radiating antenna elements, or the control of the beam width of the second polarization is made by locating the at least two chokes below the two conductive parasitic strips in relation to the main radiating antenna elements.

* * * * *